US007967501B2

(12) United States Patent
Pitrolffy et al.

(10) Patent No.: US 7,967,501 B2
(45) Date of Patent: Jun. 28, 2011

(54) MIXING PUMP

(76) Inventors: Thomas B. Pitrolffy, Lowell, MA (US); Charles H. Kelley, Peabody, MA (US)

( * ) Notice: Subject to any disclaimer, the term of this patent is extended or adjusted under 35 U.S.C. 154(b) by 1081 days.

(21) Appl. No.: 11/521,784

(22) Filed: Sep. 15, 2006

(65) Prior Publication Data

US 2008/0068923 A1 Mar. 20, 2008

(51) Int. Cl.
*B01F 5/12* (2006.01)

(52) U.S. Cl. ..... 366/182.2; 417/406

(58) Field of Classification Search ..... 366/182.2; 417/406

See application file for complete search history.

(56) References Cited

U.S. PATENT DOCUMENTS 192,433 A * 6/1877 Hickey ..... 417/406
2,100,560 A * 11/1937 Kennedy ..... 417/338

OTHER PUBLICATIONS

Exhibit "A"; "Auger" ; article retrieved from http://en.wikipedia.org/wiki/Auger,; Apr. 2007.
Exhibit "B", retrieved from the website, www.traegergrills.com, "*How It Works*," Oct. 2010.

* cited by examiner

*Primary Examiner* — David L Sorkin
(74) *Attorney, Agent, or Firm* — Arendt & Associates Intellectual Property Group; Jacqueline Arendt

(57) ABSTRACT

Disclosed is a pump for controllably dispensing an additive into a stream of liquid and mixing therewith, the pump comprising: a pump body having a passage into which a liquid stream is introduced, and from which a combination mixture of the additive and the liquid stream is discharged; a turbine supported for rotation within the passage, the incoming liquid stream striking the turbine in a manner as to impart rotation thereon; an auger housing connected to the pump body, and having an entrance end into which an additive is introduced and an exit end from which the additive is discharged into the passage, such that the additive mixes with the incoming liquid stream; and a helical lifting auger mounted on a supporting drive shaft fixedly attached to the turbine, the auger rotatably disposed within the auger housing so as to produce a fluid flow through the auger housing, the lifting auger configured to accept the additive from the auger housing entrance end; and move the additive through the auger housing to the exit end into the passage, where the additive is mixed with the incoming liquid stream by the rotation of the turbine to produce the combined mixture of additive and liquid stream. Also disclosed are a pump including a gear system to change the torque of the lifting auger, and a method of mixing an additive with a liquid stream for fire fighting; pressure washing; spraying pesticides, fungicides, or antibiotics; spray application of fertilizers; abrasive water jet cutting; and spraying food in fish farming.

16 Claims, 5 Drawing Sheets

MIXING PUMP

BACKGROUND OF THE INVENTION

Introducing an additive to a stream of water may be necessary or desirable for fire fighting; pressure washing; spraying pesticides, fungicides, or antibiotics; spray application of fertilizers; abrasive water jet cutting; and spraying food in fish farming. It may also be important to introduce an additive to a stream of a liquid other than water. The stream of water or other liquid may be pressurized or of relatively high velocity.

In fighting certain types of fires, there is often a need to add a fire retardant or a detergent or surfactant to the stream of water used to quench the fire. Because of its high surface tension, water tends to form droplets that slide off of burning fuels such as oils. Surfactants added to the water reduce the surface tension, thereby increasing the surface area of the water droplets in contact with the substance undergoing combustion, and decreasing the time needed to quench the flames.

There are many disadvantages and limitations associated with current devices and techniques used to add a liquid to a water stream. For example, currently available devices for mixing an additive into a stream of water may rely on the Bernoulli principle. The additive is drawn up from a container into the stream of water by a partial vacuum created by the flowing stream of water. The rate at which the additive enters the stream of water is difficult, if not impossible to control when the additive is drawn up solely by the vacuum. Further, such a system provides inadequate, non-uniform mixing of the additive with the water stream.

Another device may utilize an electrically powered pump to pump the additive up from a container and into the stream of water. Use of a separate, electrically powered pump is cumbersome for use in the field or at the site of a fire. Such a pump requires an electrical power source, that may not be readily available, or that could be dangerous to use in the presence of flammable liquids.

In the case of a water tank fire truck, a detergent is sometimes simply poured into the tank of water. This system provides inadequate, non-uniform mixing of the additive with the water in the tank, and little or no control over the concentration of additive in the water stream.

In any of the current methods described above, sufficient dispersal or mixing of the additive is often inadequate for the particular use. Thus, a need exists for a more effective means and apparatus to controllably introduce an additive to a stream of a liquid and to mix the additive adequately with the stream of liquid.

In the case of fire fighting, the uniform addition and mixing of a surfactant with the water stream exiting the water hose would allow the water to be used more efficiently, thereby reducing the time needed to quench the fire, and reducing the amount of water needed to quench the fire. By reducing the time required to put out a blaze, the improvements disclosed herein are likely to also lessen the exposure to heat, toxic products of combustion, and other dangers that fire fighters face, and to reduce the damage to property caused by fire and water.

SUMMARY OF THE INVENTION

Disclosed herein are a device and method that provide for such uniform addition, control, and mixing of an additive with a liquid stream. The invention inter alia includes the following, alone or in combination. One embodiment of the invention is a pump for controllably dispensing an additive into a liquid stream and mixing therewith, the pump comprising: a pump body having a passage with a liquid inlet end into which a liquid stream is introduced, and an outlet end from which a combination mixture of the additive and the liquid stream is discharged; a turbine supported for rotation within the passage of the pump body between the liquid inlet end and the outlet end, the passage being so shaped that the incoming liquid stream flowing in the passage strikes the turbine in a manner as to impart rotation thereon; an auger housing fixedly connected to the pump body, and having an auger housing entrance end into which an additive is introduced and an auger housing exit end from which the additive is discharged, the auger housing exit end in fluid communication with the passage of the pump body between the liquid inlet end and the outlet end, such that the additive discharged from the auger housing exit end mixes with the incoming liquid stream flowing in the passage of the pump body; and a helical lifting auger mounted on a supporting drive shaft fixedly attached to the turbine, the auger rotatably disposed within the auger housing so as to produce a fluid flow through the auger housing, the lifting auger configured to accept the additive from the auger housing entrance end; and move the additive through the auger housing to the auger housing exit end into the passage of the pump body, where the additive is mixed with the incoming liquid stream by the rotation of the turbine to produce the combined mixture of additive and liquid stream.

The passage may include a mixing chamber portion between the liquid inlet end and the outlet end, the mixing chamber in fluid communication with the exit end of the auger housing.

Disclosed also is a pump for controllably dispensing an additive into a liquid stream and mixing therewith, the pump comprising: a pump body having a passage with a liquid inlet end into which a liquid stream is introduced, and an outlet end from which a combination mixture of the additive and the liquid stream is discharged; a turbine supported for rotation within the passage of the pump body between the liquid inlet end and the outlet end, the passage being so shaped that the incoming liquid stream flowing in the passage strikes the turbine in a manner as to impart rotation thereon; an auger housing fixedly connected to the pump body, and having an auger housing entrance end into which an additive is introduced and an auger housing exit end from which the additive is discharged, the auger housing exit end in fluid communication with the passage of the pump body between the liquid inlet end and the outlet end, such that the additive discharged from the auger housing exit end mixes with the incoming liquid stream flowing in the passage of the pump body; and a helical lifting auger mounted on a supporting drive shaft attached to a gear system attached to the turbine, the auger rotatably disposed within the auger housing so as to produce a fluid flow through the auger housing, the lifting auger configured to accept the additive from the auger housing entrance end; and move the additive through the auger housing to the auger housing exit end into the passage of the pump body, where the additive is mixed with the incoming liquid stream by the rotation of the turbine to produce the combined mixture of additive and liquid stream.

In one embodiment of the disclosed pump the gear system comprises a follower gear meshed with or otherwise disposed in geared engagement with a driver gear, the driver gear fixedly connected to a shaft that is attached to the turbine; and the follower gear fixedly connected to the supporting drive shaft of the lifting auger.

Another embodiment of the invention is a method of mixing an additive dispersed in a liquid or in liquid form with a stream of liquid using a disclosed pump.

The present invention has many advantages. The invention provides a more effective means and apparatus to controllably introduce an additive to a stream of liquid, to control the proportions of additive to liquid, and to mix the additive adequately with the stream of liquid.

In the case of fire fighting, the use of a disclosed pump provides for the uniform and controlled addition and mixing of a surfactant, a foaming agent, or other fire-fighting agent with the high pressure water stream exiting the water hose, thereby allowing the water to be used more efficiently, reducing the time needed to quench the fire, and reducing the amount of water needed to quench the fire. By reducing the time to put out a blaze, the improvements disclosed herein are likely to also lessen the exposure to heat, toxic products of combustion, and other dangers that fire fighters face, and to reduce the damage to property caused by fire and water.

BRIEF DESCRIPTION OF THE DRAWINGS

The foregoing and other objects, features and advantages of the invention will be apparent from the following more particular description of illustrative embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

Figure 1:
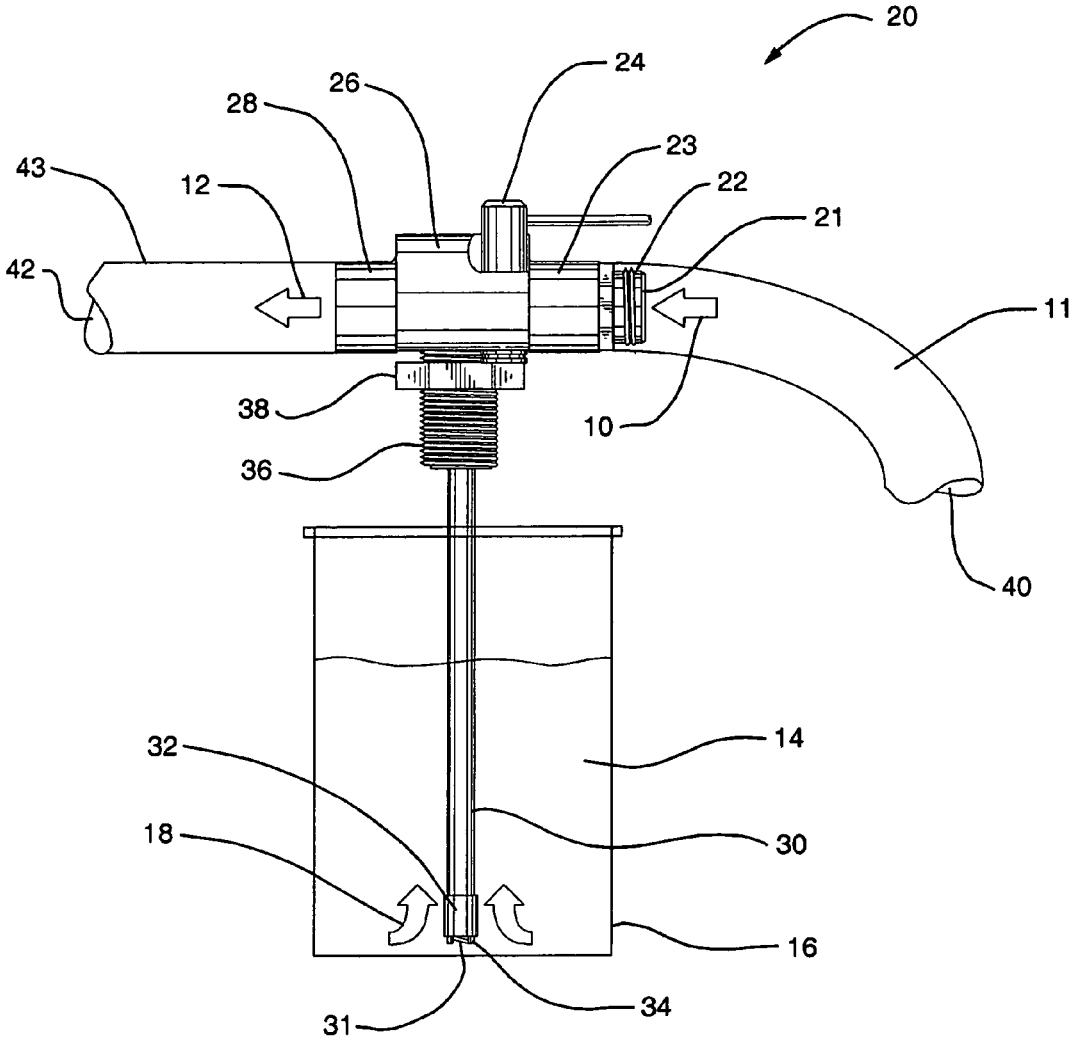
FIG. 1 is a schematic view of an apparatus according to an embodiment of the invention.

A description of preferred embodiments of the invention follows. It will be understood that the particular embodiments of the invention are shown by way of illustration and not as limitations of the invention. At the outset, the invention is described in its broadest overall aspects, with a more detailed description following. The features and other details of the compositions and methods of the invention will be further pointed out in the claims.

The present invention is directed to an apparatus and methods for controllably dispensing an additive into a stream of liquid and mixing the additive with the stream of liquid to produce a combined mixture of additive and liquid stream. The liquid stream employed may be relatively fast moving or pressurized.

One embodiment of the invention comprises a pump body having a passage with a liquid inlet end into which a liquid stream may be introduced, and an outlet end from which the liquid stream mixed with the additive may be discharged. The passage between the liquid inlet end and the outlet end may comprise a mixing chamber. Non-limiting examples of additives suitable for use in an embodiment of the invention include a fire retardant fluid, a foaming agent, a detergent or other surfactant, an abrasive, a fertilizer, an insecticide, a fungicide, an antibiotic, an antiviral agent, and food for fish farming.

A disclosed pump comprises a liquid-driven turbine disposed in the passage between the liquid inlet end and the outlet end of the pump body. The turbine is fixedly connected to an auger drive shaft that is fixedly attached to a helical lifting auger rotatably disposed in an auger housing. The end of the auger housing distal to the turbine can be removably connected to a reservoir or container containing an additive in liquid form. The passage of the pump body is so shaped that the incoming liquid stream flowing in the passage strikes the turbine in a manner as to impart rotation thereon. The rotation of the turbine imparts rotation on both the auger drive shaft supporting the auger and on the attached auger.

The rotation of the helical lifting auger transfers a portion of the additive from the reservoir through the auger housing, out the auger housing exit end, and into the passage of the pump body where the portion of the additive mixes with the incoming liquid stream flowing in the passage of the pump body to produce a combined mixture of additive and liquid stream. The transfer of the additive from the reservoir occurs as the rotation of the auger moves the additive in liquid form from the reservoir through the auger housing and into the mixing chamber where the additive is mixed with the stream of liquid before the liquid is discharged from the outlet end of the pump body.

An apparatus and method according to embodiments of the invention can be used in any situation wherein it is desirable to mix an additive with a stream of water or other liquid. Examples of such uses include, but are not limited to fire fighting; power washing; spraying pesticides, fungicides, or antibiotics; spray application of fertilizers; abrasive water jet cutting; and spraying food or antibiotics in fish farming. The water or other liquid may or may not be at relatively high pressure or velocity.

Turning now to the drawings, FIG. 1 is a schematic representation of an embodiment of the disclosed system. One embodiment of the invention is a mixing pump (20) designed to transfer an additive (14) in liquid form, for example in solution or suspension, from a container (16) through an auger housing (30) conduit into a mixing chamber (41) (See FIG. 2.) formed by outer wall (26) and housing (23). In the embodiment depicted in FIG. 1, the auger housing (30) is secured to the outer wall (26) of the mixing chamber (41) by a cylindrical, threaded connector (36) fitted with lock nut (38). The location of the mixing chamber (41) is depicted in the exploded partial cutaway view of the pump body (60) shown in FIG. 2.

In order to allow the additive (14) to move through the auger housing inlet (31) into the auger housing (30), the housing (30), at the inlet (31), has a base (32) with projecting legs (34) that support the auger housing (30) and keep the auger housing inlet (31) displaced from the bottom of the container (16). The additive (14) moves into auger housing (30) inlet (31). The direction of movement of additive (14) is shown by arrows (18). In one embodiment of the disclosed pump (20), the additive (14) is drawn up through auger housing (30) and out an exit end of the auger housing (30) into mixing chamber (41).

Figure 2:
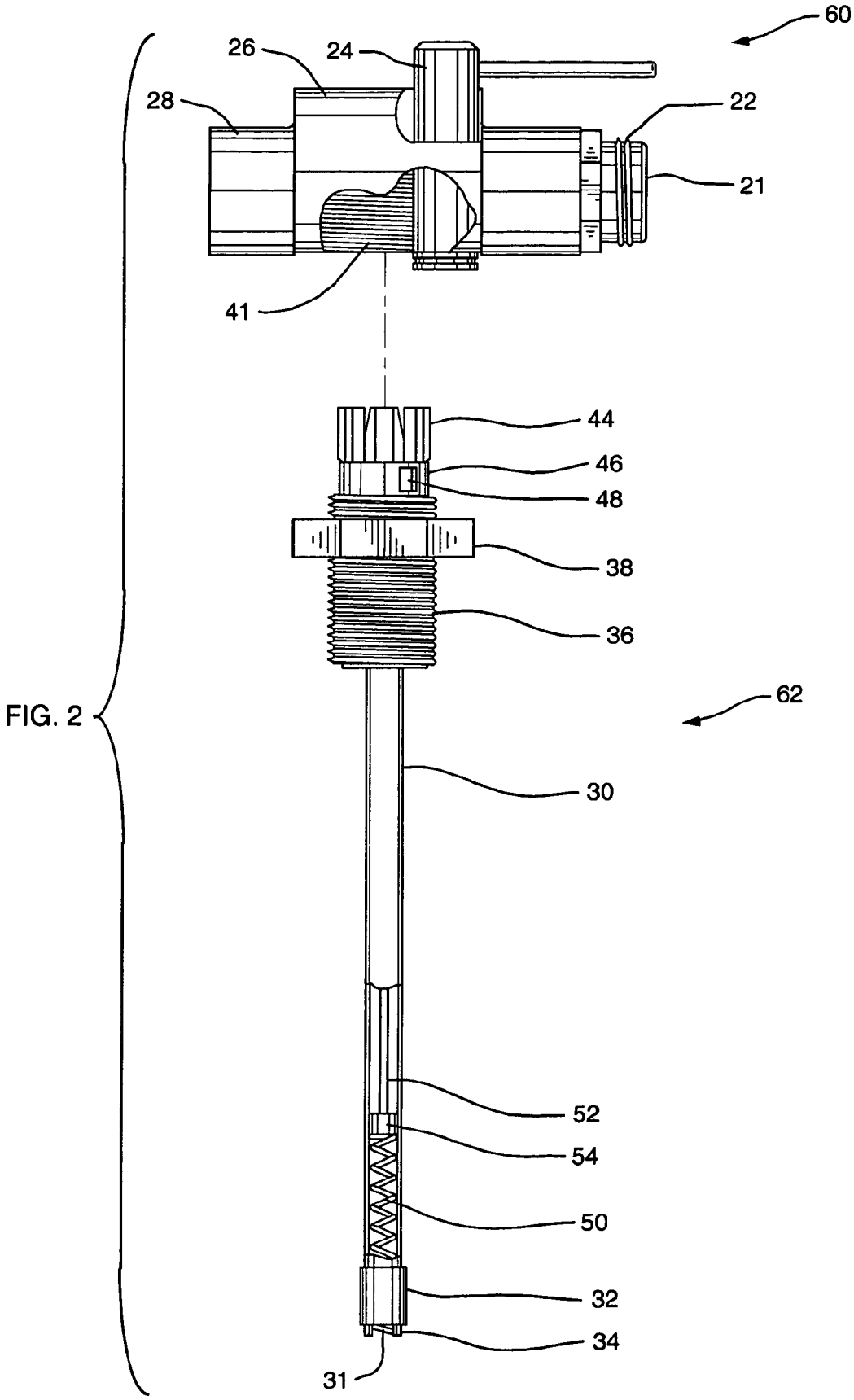
FIG. 2 is an exploded partial cutaway view of mixing pump components according to an embodiment of the invention.
Figure 5:
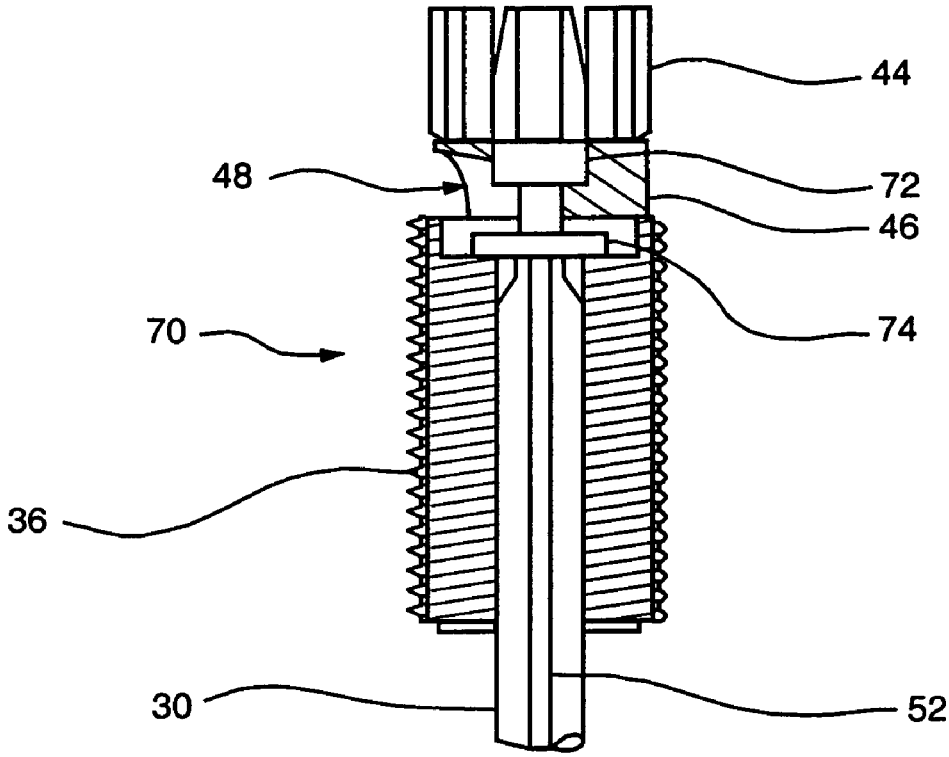
FIG. 5 is a schematic partial cutaway view of a section of a disclosed mixing pump showing the interior of the turbine base.

In the embodiment depicted in FIG. 2, a cylindrical turbine base (46) is concentric with and fixedly attached to the auger housing (30) near the exit end of the auger housing (30). The exit end of the auger housing (30) is in fluid communication with the interior hollow defined by the cylindrical turbine base (46) and may or may not protrude into the hollow. A partial cutaway view of the cylindrical turbine base (46) is shown in FIG. 5, described below. The exit end of the auger housing (30) is therefore also in fluid communication with an opening (48) in the cylindrical turbine base (46) for discharge of the additive (14) into the mixing chamber (41).

Without departing from the spirit and scope of the invention, other arrangements are possible. An embodiment of an alternative arrangement generally could position the exit end of the auger housing (30) in fluid communication with the mixing chamber (41), or within a passage in the pump body (60) between the liquid inlet end (21) into which a liquid stream may be introduced, and an outlet end (28) from which the liquid stream mixed with the additive (14) may be discharged. (See arrow (12) in FIG. 1 indicating direction of movement of combined mixture of liquid stream and additive exiting mixing chamber (41).)

Figure 3:
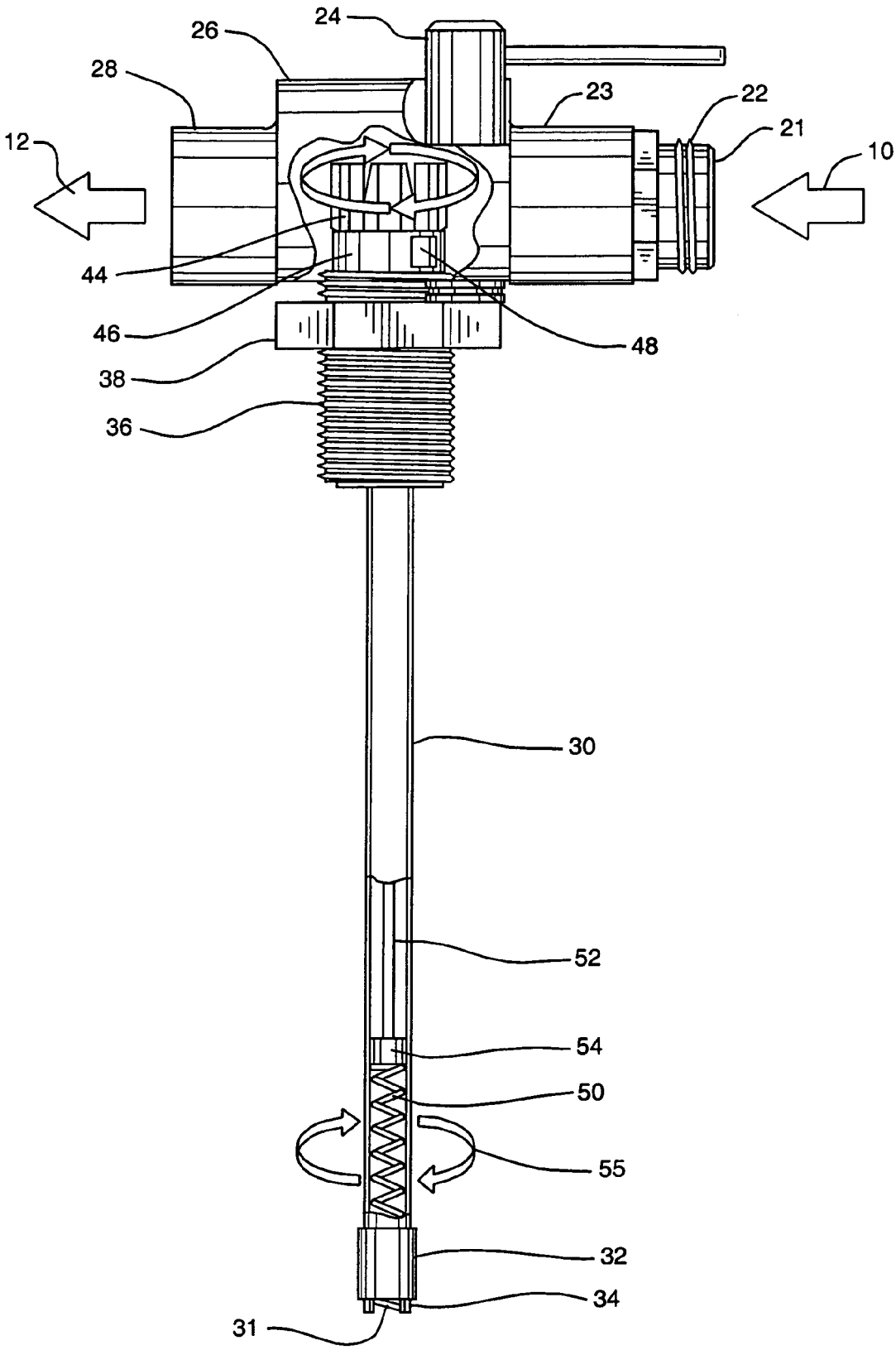
FIG. 3 is a side elevation view of a disclosed apparatus with partial cutaway.

In one embodiment, the turbine (44) is positioned on top of, and rotates on top of the cylindrical turbine base (46). (See, for example, FIGS. 2, 3, and 5.) See direction of arrows shown in FIG. 3 at turbine (44), the direction of arrows indicating direction of rotation of turbine (44). The turbine (44) is configured so that the flow of the liquid stream over the vanes of turbine (44) causes the turbine (44) to rotate. In FIG. 3, the direction of rotation of the helical lifting auger (50) is indicated by the direction of arrows (55), and is the same as the direction of rotation of the turbine (44) to which the auger (50) is fixedly attached by supporting auger drive shaft (52), which also rotates in the direction indicated by arrows (55).

In FIG. 3, as described above, both the turbine (44) and the helical lifting auger (50) have a clockwise rotation, as indicated by the direction of the arrows depicted around turbine (44) and by the direction of arrows (55). However, the direction of rotation of the turbine (44) and the helical lifting auger (50) in the disclosed pump is not limited to a clockwise rotation. In another embodiment, the shape of the vanes of the turbine (44) are such that a counterclockwise rotation is produced when the incoming liquid stream flowing in the passage strikes the turbine (44) in a manner as to impart rotation thereon.

The scope of the present invention is not limited to the arrangement depicted in the drawings. With no more than routine experimentation, modifications of the pump may be necessary or desirable to adapt the pump for a particular use. Such modifications or adjustments may be necessary or desirable to improve the performance of a disclosed pump when used with liquid streams of various pressures or with liquid additives of relatively high viscosity.

FIG. 1 also shows a liquid supply hose (11) having a liquid supply inlet (40) upstream of the mixing chamber (41) (See FIG. 2.). The liquid supply hose (11) delivers an incoming stream of liquid, having direction shown by arrow (10), the liquid stream entering the hose adaptor or liquid inlet (21) of the mixing chamber (41). The housing (23) with liquid inlet (21) has a threaded adapter (22) which is adapted to fit the inside diameter of the type of liquid supply hose (11) used in the operation. The adapter (22) can be easily replaced with an adapter threaded to fit any one of various types of liquid supply hoses.

Arrow (12) indicates the direction of movement of the combined mixture of additive and liquid as the mixture exits the mixing chamber (41) through the outlet hose connector (28) and moves through hose (43) downstream of the mixing chamber (41) and exits through combined mixture outlet (42).

FIG. 2 is an exploded partial cutaway view of an embodiment of the invention showing some of the components of a disclosed a mixing pump. The pump body (60) has a partial cutaway to show the mixing chamber (41) and flow regulator (24) that can control the rate at which the liquid stream enters the mixing chamber (41). The flow regulator (24) can optionally be used to adjust the rate at which the incoming liquid stream (10) enters the mixing chamber (41).

The flow regulator (24) may be pressure set or may be screwed into the device. From the view shown in FIG. 2, it can be seen that, without departing from the spirit and scope of the invention, a valve or other type of control could be used in place of the flow regulator (24) depicted in the drawings. In one embodiment the valve is a butterfly type valve.

Mixing chamber (41) formed by outer wall (26) is in fluid communication with an incoming stream of liquid (10). The incoming liquid stream (10) enters the liquid inlet (21) of the mixing chamber (41). The additive (14) is carried up through auger housing (30) and discharged through the housing's exit end and out of opening (48) in the cylindrical turbine base (46) into the mixing chamber (41), where the additive (14) is mixed with the incoming liquid stream, the mixing process promoted by the rotation of turbine (44).

In one embodiment of the disclosed pump, the mixing chamber (41) is in fluid communication with the auger housing (30). In one embodiment of the pump, a filter is interposed between the mixing chamber (41) and opening (48). In another embodiment, a filter is positioned between the liquid inlet (21) and the mixing chamber (41).

In FIG. 2, the bottom portion (62) of the mixing pump (20) has a partial cutaway to show a rotatable helical lifting auger (50) located within the auger housing (30) and fixedly attached at its upper end to a supporting drive shaft (52) by base (54) of auger drive shaft (52).

Cylindrical threaded connector (36) fitted with lock nut (38) has a first end fixedly attached to auger housing (30), and a second end fixedly secured to outer wall (26) of the mixing chamber (41) and to cylindrical base (46) of turbine (44). Various alternative means of connecting the auger housing (30) to the mixing chamber (41) or the pump body (60) are within the scope of the invention. For example, in another embodiment, a bayonet-type connector is used. In yet another embodiment, the auger housing (30) may be secured to the pump body (60) by a "push-turn-clamp" type connection.

In one embodiment of the invention, the container (16) may be a container into which the disclosed pump may be inserted. In another embodiment, the disclosed pump may be incorporated as part of the container (16). In another embodiment the additive (14) is included in the container (16) incorporating the disclosed pump. In yet another embodiment, a flange may be included on the auger housing (30) to sealably mount the disclosed pump to the container (16) in order to prevent spillage of the additive (14) in the event that the container (16) is tipped over during use.

Turbine (44) is rotatably mounted within mixing chamber (41) and rotates in response to the impinging of the incoming liquid stream on the turbine (44). The incoming liquid stream exerts a force on the turbine. The turbine (44) is configured so that the flow of the incoming liquid stream over the vanes of the turbine (44) causes the lifting auger's supporting drive shaft (52) to rotate. The direction of the incoming liquid stream is indicated by arrow (10) in FIG. 1 and FIG. 3. The turbine base (46) does not rotate. Turbine (44) is fixedly attached to the end of the lifting auger's supporting drive shaft (52) that is opposite drive shaft base (54), and therefore helical lifting auger (50) rotates as turbine (44) rotates. The additive (14) is conveyed from the container (16) into auger housing entrance end (31) by the rotation of the helical lifting auger (50).

In one aspect, the pump can act as a liquid-driven auger dispenser. The turbine (44) serves two functions in the disclosed pump system. First, as the incoming liquid stream strikes the turbine (44), the turbine (44) rotates and causes the helical lifting auger (50) attached to the turbine (44) by a supporting auger drive shaft (50) to rotate so as to produce a fluid flow through the housing (30) and accept the additive (14) from the auger housing entrance end (31) and move the additive (14) through the auger housing (30) to the housing exit end within the chamber of turbine base (46) and out opening (48), where the additive (14) enters the liquid stream within the mixing chamber (41) portion of the passage within the pump body (60).

Secondly, because the turbine (44) is positioned within the mixing chamber (41), the rotation of the turbine (41) is also a means for mixing the additive (14) with the incoming liquid stream in the mixing chamber (41) to produce a combined mixture of additive and liquid stream, that moves out through combined mixture outlet (42) in hose (43) in the direction indicated by arrow (12).

Many types of turbines are suitable for use in an embodiment of the invention. A turbine (44) suitable for use in an embodiment of the invention may comprise a plurality of radially extending, angled blades or vanes to translate the energy of a liquid stream impinging on the blades into rotational motion that can impart rotation on the attached supporting drive shaft (52) of the helical lifting auger (50). The turbine vanes can be curved, straight, or pitched. The turbine (44) can be made of various materials, e.g., metals such as brass, bronze, stainless steel, and plastics or polymers.

The auger housing (50) serves as a conduit for the additive (14) from the container or reservoir (16) into the passage of the pump body (60) where it is mixed with the liquid stream. The auger housing (50) can be made of a variety of suitable materials, including a metal or alloy, a rigid polymer, a flexible material, and an elastically compressible material. The term "flexible" as used herein refers to a property whereby the material described as flexible can be bent without breaking and without completely blocking or closing the passageway within a tube comprising the material. As used herein, the term "elastically compressible" means that the material so described can be mechanically squeezed or compressed without breaking and can return to substantially its original shape after being squeezed or compressed.

Many types of lifting augers (50) may be employed according to an embodiment of the invention. In one embodiment of the invention, the lifting means is an auger (50) incorporating one or more inclined screw helices, for example, Archimedes screw helices, which convey the additive (14) through the auger housing (30) into the mixing chamber (41). The inventors of the present subject matter have used a coil-type spring as an auger in one embodiment of the pump.

In another embodiment the lifting auger (50) may be a flight conveyer or worm mounted on a supporting drive shaft (52) of the auger. The lifting auger (50) can have a bladed portion, commonly known as conveying flights, for lifting and removing material. In another embodiment the lifting auger (50) can be a single threaded screw or a coil. The screw-type lifting auger (50) used in an embodiment of the invention can comprise a continuous helical groove on a shaft, or a type of helical advancing spiral elements.

In one embodiment of the pump, the auger flights preferably are close to the auger housing wall, but not touching or frictionally engaging the auger housing wall (30). In another embodiment the lifting auger (50) comprises a coil or spring wherein the spring does make contact with the auger housing wall (30).

The screw can be an inclined screw-type lift auger (50) disposed so as to accept material or additive (14) from the container (16) and move the additive (14) up the auger housing (30) conduit to the mixing chamber (41). In another embodiment of the disclosed pump, the lifting auger (50) can be an impeller with a plurality of radially extending blades or fins on a drive shaft (52).

In contrast to some currently available devices which rely solely on the Bernoulli principle, the liquid-driven turbine (44) and lifting auger (50) of the disclosed pump are the primary means for introducing and mixing an additive (14) with the stream of liquid.

FIG. 3 is a side elevational view of the mixing pump (20) with partial cutaway. Arrows (55) indicate the direction of rotation of the auger (50), which is the same as the direction of rotation of the turbine (44).

Figure 4:
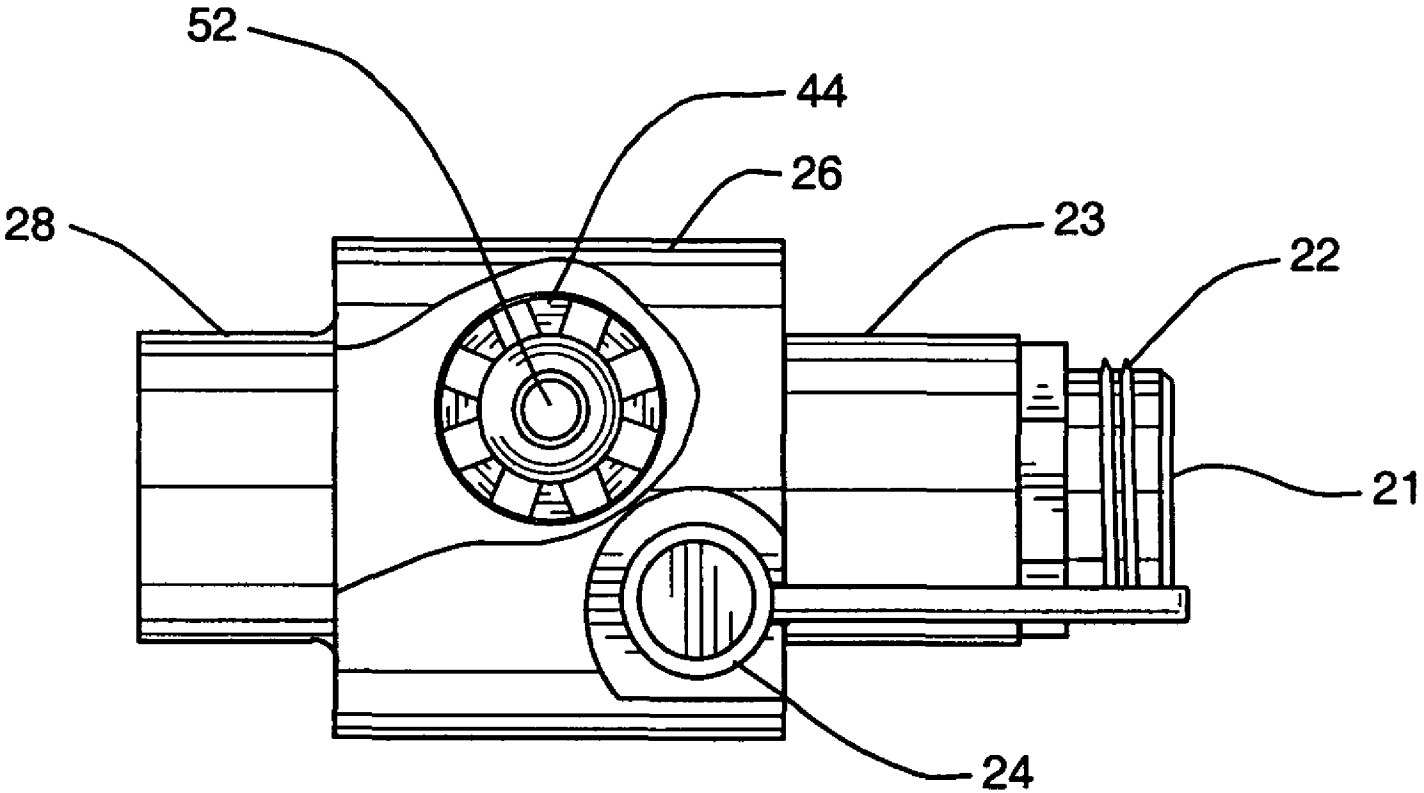
FIG. 4 is a top plan partial cutaway view of a disclosed mixing pump showing an offset of the flow regulator from the turbine.

FIG. 4 is a top plan partial cutaway view of a disclosed mixing pump (20). An offset of the flow regulator (24) from the turbine (44) is clearly shown in this view. Other configurations will work, but it is necessary to have an offset of the flow regulator (24) from the turbine (44). This view also shows one type of vane suitable for use in a turbine (44), and the supporting auger drive shaft (52) fixedly attached to the turbine (44).

FIG. 5 is a schematic partial cutaway view of a section (70) of a disclosed mixing pump (20) showing the interior of the turbine base (46). In FIG. 5, the turbine (44) is shown resting on a bearing (72), the bearing (72) positioned within the turbine base (46). A number of metals and alloys, for example, bronze, are suitable for use as a material used to produce the bearing (72). In assembling a disclosed mixing pump (20), the supporting auger drive shaft (52) is inserted through the center of the bearing (72) and the turbine (44). The arrangement is depicted in FIG. 4 and FIG. 5. Although the bearing (72) could rotate, the inventors of the present subject matter have determined that in the various embodiments of the pump that have been tested, the pump (20) functions best if the bearing (72) does not rotate.

In FIG. 5, a check valve (74) having a disc shape is shown in a lowered position in which the check valve (74) seals off the auger housing (30) to prevent or to minimize backflow of the liquid stream into the auger housing (30). In one embodiment of the mixing pump (20), the check valve (74) is a disc having an annular opening in the center thereof. The check valve (74) may comprise materials such as, for example, a plastic such as DELRIN® (DuPont de Nemours, Wilmington, Del.), a fluoropolymer resin such as TEFLON® (DuPont de Nemours), or a metal or an alloy. In one embodiment, the check valve may comprise a combination of such materials. For example, in one embodiment the check valve may be a disc comprising stainless steel and DELRIN® or TEFLON®, both of which are more compressible than steel, attached to the stainless steel around the circumference of the disc. TEFLON® is more compressible than DELRIN® and thus TEFLON® may provide a better seal.

During operation of the mixing pump (20), the check valve (74) rides back and forth on a shaft inserted through the center opening of the check valve. The shaft is positioned directly beneath and adjacent to the bearing (72). When the incoming liquid stream, having direction shown by arrow (10) in FIG. 1 and FIG. 3, is at sufficient pressure, check valve (74) will be elevated to a position just beneath and adjacent to bearing (72); and the additive (14) will move up through auger housing (30) and out opening (48) in the turbine base (46) into the mixing chamber (41).

However, if the pressure of the incoming liquid stream decreases at the liquid inlet end (21), for example when the incoming liquid stream is shut off at the source or at the flow regulator (24), the liquid pressure at the outlet end (28) will cause the combined mixture of additive and liquid stream (the outgoing direction of which is indicated by arrow (12)) to back up through opening (48) and push check valve (74) down, thereby sealing off the exit end of auger housing (30) and preventing backflow of the mixture of additive and liquid stream down the auger housing (30).

A particular liquid additive may be of relatively high viscosity. Further, a liquid stream may be of relatively low pressure. For example, in many Latin countries pumper trucks are generally not available, and water for firefighting is supplied from available water resources, which may be at low pressure. Although the disclosed pump works with additives in a wide range of viscosities, and with liquid streams in a wide range of pressures, modifications or adjustments may be necessary or desirable to improve the performance of a disclosed pump when used with liquid streams of relatively low pressure or with liquid additives of relatively high viscosity.

For use of the disclosed pump with liquid streams of relatively low pressure, one such adjustment may be the use of a motorized gear system to push a liquid stream, such as water used for fire-fighting, to a higher pressure.

Alternatively, with no more than routine experimentation, modifications to increase the torque of the lifting auger (50) or of the turbine (44) may be made to the disclosed pump. A non-limiting example includes gearing down the turbine (44), to better handle liquid streams at relatively low pressure, and/or additives (14) of relatively high viscosity. Gears may be used to increase or to decrease the torque of the lifting auger (50), that is, the lifting auger's power of turning. If a gear system is used, the direction of rotation of the lifting auger (50) may be opposite that of the turbine (44). In one embodiment of the disclosed pump, a gear system used to increase the power of turning of the lifting auger (50) may require that the turbine (44) is not directly connected to the supporting drive shaft (52) of the lifting auger (50). For example, the turbine (44) may be attached to a shaft that is attached to a driver gear connected to a follower gear. In one embodiment of the disclosed pump, the gear system comprises a follower gear meshed with or otherwise disposed in geared engagement with a driver gear, the driver gear fixedly connected to a shaft that is attached to the turbine; and the follower gear fixedly connected to the supporting drive shaft of the lifting auger.

The disclosed pump may include a follower gear that is larger than the driver gear. The larger follower gear, having decreased speed but increased turning power, is then fixedly connected to the supporting drive shaft (52) of the lifting auger (50). The result is an increase in the lifting auger's torque such that the pump can handle additives (14) of relatively high viscosity and/or the pump can be used with liquid streams of relatively low pressure.

In another embodiment, the pump includes a follower gear that is smaller than the driver gear. The smaller follower gear, having increased speed but decreased turning power, is then fixedly connected to the supporting drive shaft (52) of the lifting auger (50). The speed of the lifting auger (50) is increased by such "gearing up", with resulting increased speed of delivery of the additive (14), but a decrease in the lifting auger's torque. Such gearing up may be appropriate for handling additives (14) of relatively low viscosity.

As described earlier, the drawings herein are not necessarily to scale. In one embodiment of the pump, in order to increase torque, the size of the turbine used is increased.

Modifications of the illustrated check valve and other types of check valves or backflow prevention valves are within the scope of the disclosed invention.

As schematically shown in FIGS. 1 through 5, one embodiment of the invention is a pump for controllably dispensing an additive into a liquid stream and mixing therewith, the pump comprising: a pump body (60) having a passage with a liquid inlet end (21) into which a liquid stream is introduced, and an outlet end (28) from which a combination mixture of the additive and the liquid stream is discharged; a turbine (44) supported for rotation within the passage of the pump body between the liquid inlet end and the outlet end, the passage being so shaped that the incoming liquid stream flowing in the passage strikes the turbine in a manner as to impart rotation thereon; an auger housing (30) fixedly connected to the pump body (60), and having an auger housing entrance end (31) into which an additive (14) is introduced and an auger housing exit end from which the additive is discharged, the auger housing exit end in fluid communication with the passage of the pump body between the liquid inlet end (21) and the outlet end (28), such that the additive discharged from the auger housing exit end mixes with the incoming liquid stream flowing in the passage of the pump body; and a helical lifting auger (50) mounted on a supporting drive shaft (52) fixedly attached to the turbine (44), the auger (50) rotatably disposed within the auger housing (30) so as to produce a fluid flow through the auger housing (30), the lifting auger configured to accept the additive from the auger housing entrance end (31); and move the additive through the auger housing (30) to the auger housing exit end into the passage of the pump body, where the additive is mixed with the incoming liquid stream by the rotation of the turbine (44) to produce the combined mixture of additive and liquid stream (12).

Another embodiment of the invention is a pump for controllably dispensing an additive into a liquid stream and mixing therewith, the pump comprising: an auger housing (30) having an auger housing entrance end (31) into which a additive (14) may be introduced and an auger housing exit end from which the additive may be discharged; a helical lifting auger (50) mounted on a supporting drive shaft (52) and rotatably disposed within the auger housing (30) so as to produce a fluid flow through the auger housing (30) and accept the additive from the auger housing entrance end (31) and move the additive through the auger housing to the auger housing exit end; a pump body (60) fixedly connected to the auger housing (30), the pump body having a passage with a liquid inlet end (21) into which a liquid stream may be introduced, the passage including a mixing chamber (41) in fluid communication with the auger housing exit end and configured to accept the additive from the auger housing exit end, and an outlet end (28) from which a combined mixture of additive and liquid stream may be discharged; and a turbine (44) fixedly attached to the supporting drive shaft (52) of the helical lifting auger (50), the turbine supported within the passage of the pump body between the liquid inlet end and the outlet end, the passage being so shaped that the incoming liquid stream flowing in the passage strikes the turbine in a manner as to impart rotation thereon; the rotation of the turbine imparting rotation on the helical lifting auger and mixing the additive introduced by the lifting auger with the incoming liquid stream to produce a combined mixture of additive and liquid stream.

The invention inter alia also includes the following embodiments, alone or in combination. The invention also relates to a method of mixing an additive with a liquid stream, the method comprising: providing a pump as disclosed herein; establishing fluid communication of the auger housing entrance end of the pump with an additive within a reservoir surrounding the auger housing; connecting the pump to the liquid stream at the liquid inlet end of the passage of the pump body; allowing the liquid stream to strike the turbine of the pump in a manner as to impart rotation thereon; allowing the rotation of the turbine to impart rotation on the helical lifting auger; and allowing the rotation of the helical lifting auger to transfer a portion of the additive from the reservoir through the auger housing, out the auger housing exit end, and into the passage of the pump body where the portion of the additive mixes with the incoming liquid stream flowing in the passage of the pump body to produce a combined mixture of additive and liquid stream.

The liquid stream utilized in the disclosed method of mixing an additive with a liquid stream may comprise a water stream; non-limiting examples of the additive include pesticides, fungicides, antibiotics, fertilizers; and fish food; and the method may further comprise spraying the mixture of additive and water stream on a target area.

The disclosed pump may be used to introduce an additive into a high velocity or pressurized stream of water.

The liquid stream utilized in the disclosed method of mixing an additive with a liquid stream may comprise a water stream; the additive may comprise an abrasive; and the method may further comprise introducing the mixture of abrasive and water stream into a water jet machine to form a water jet comprising the abrasive; and cutting a material with the water jet. An abrasive water jet machine may utilize an additive such as garnet or ruby in a water jet at high pressure to cut materials such as steel, bluestone, and granite.

Another embodiment of the invention is a method of extinguishing fires by connecting a disclosed pump to a water stream; allowing the force of the water stream, which may be at high velocity or high pressure, to rotate the turbine of the pump, thereby causing the helical lifting auger to rotate and controllably transfer portions of an additive, e.g., a detergent, foaming agent, or other surfactant from a reservoir or container into the water stream, producing an additive-water stream mixture that is sprayed on the fire.

As such, the disclosed method of extinguishing a fire comprises: providing a pump as disclosed herein; establishing fluid communication of the auger housing entrance end of the pump with an additive within a reservoir surrounding the augur housing, the additive chosen from a fire retardant and a surfactant; connecting the pump to a water stream at the liquid inlet end of the passage of the pump body; allowing the water stream to strike the turbine of the pump in a manner as to impart rotation thereon, allowing the rotation of the turbine to impart rotation on the helical lifting auger; allowing the rotation of the helical lifting auger to transfer a portion of the additive from the reservoir through the auger housing, out the auger housing exit end, and into the passage of the pump body where the portion of the additive mixes with the incoming water stream flowing in the passage of the pump body to produce a combined mixture of additive and water stream; and spraying the combined mixture of additive and water stream on the fire for a period of time sufficient to extinguish the fire.

The invention also relates to a method of pressure washing a surface comprising: providing a pump as disclosed herein; establishing fluid communication of the auger housing entrance end of the pump with an additive within a reservoir surrounding the auger housing; connecting the pump to a water stream at the liquid inlet end of the passage of the pump body; allowing the water stream to strike the turbine of the pump in a manner as to impart rotation thereon; allowing the rotation of the turbine to impart rotation on the helical lifting auger; allowing the rotation of the helical lifting auger to transfer a portion of the additive from the reservoir through the auger housing, out the auger housing exit end, and into the passage of the pump body where the portion of the additive mixes with the incoming water stream flowing in the passage of the pump body to produce a combined mixture of additive and water stream; and spraying the combined mixture of additive and water stream on the surface for a period of time sufficient to clean the surface.

The foregoing disclosure is not to be construed to limit the present invention or otherwise to exclude other embodiments, adaptations, variations, modifications and equivalent arrangements. The design of the disclosed pump can be adjusted for either liquid streams or additives of higher viscosity.

EQUIVALENTS

While this invention has been particularly shown and described with references to preferred embodiments thereof, it will be understood by those skilled in the art that various changes in form, dimensions, and details, such as, for example, changes in the construction and operation of various described components and assemblies thereof, may be made therein without departing from the scope of the invention encompassed by the appended claims. It will therefore be readily understood by those skilled in the art that the present invention is susceptible of a broad utility and application.

What is claimed is:

1. A pump for controllably dispensing an additive into a liquid stream and mixing therewith, the pump comprising:

a) a pump body comprising a housing having a passage therethrough with a liquid inlet end into which a liquid stream is introduced, the liquid inlet end comprising an adapter which is adapted to fit an inside diameter of a liquid supply hose, and an outlet end from which a combination mixture of the additive and the liquid stream is discharged;

b) a flow regulator positioned inside the passage and configured to adjust the rate at which the incoming liquid stream enters the passage;

c) a turbine supported by a cylindrical turbine base for rotation within the passage of the pump body between the liquid inlet end and the outlet end, the passage being so shaped that the incoming liquid stream flowing in the passage strikes the turbine in a manner as to impart rotation thereon;

d) a cylindrical threaded connector having a first end fixedly attached to an auger housing and a second end fixedly secured to the cylindrical base of the turbine, the auger housing comprising an auger housing entrance end into which an additive is introduced and an auger housing exit end from which the additive is discharged, the auger housing exit end in fluid communication with the passage of the pump body between the liquid inlet end and the outlet end, such that the additive discharged from the auger housing exit end mixes with the incoming liquid stream flowing in the passage of the pump body; and e) a helical lifting auger mounted on a supporting drive shaft fixedly attached to the turbine, the auger rotatably disposed within the auger housing so as to produce a fluid flow through the auger housing, the lifting auger configured to accept the additive from the auger housing entrance end; and move the additive through the auger housing to the auger housing exit end into the passage of the pump body, where the additive is mixed with the incoming liquid stream by the rotation of the turbine to produce the combined mixture of additive and liquid stream.

2. The pump of claim 1, wherein the passage of the pump body includes a mixing chamber between the liquid inlet end and the outlet end, the mixing chamber in fluid communication with the auger housing exit end.

3. The pump of claim 1, wherein the flow regulator is chosen from a moveable pressure set rod and a valve.

4. A method of mixing an additive with a liquid stream, the method comprising:

providing a pump according to claim 1;

establishing fluid communication of the auger housing entrance end of the pump with an additive within a reservoir surrounding the auger housing;

connecting the pump to the liquid stream at the liquid inlet end of the passage of the pump body;

allowing the liquid stream to strike the turbine of the pump in a manner as to impart rotation thereon;

allowing the rotation of the turbine to impart rotation on the helical lifting auger;

allowing the rotation of the helical lifting auger to transfer a portion of the additive from the reservoir through the auger housing, out the auger housing exit end, and into the passage of the pump body where the portion of the additive mixes with the incoming liquid stream flowing in the passage of the pump body to produce a combined mixture of additive and liquid stream.

5. The method of claim 4, wherein:

the liquid stream comprises a water stream; the additive is chosen from pesticides, fungicides, antibiotics, fertilizers; and fish food; and the method further comprises spraying the mixture of additive and water stream on a target area.

6. The method of claim 4, wherein:

the liquid stream comprises a water stream; the additive comprises an abrasive; and the method further comprises introducing the mixture of abrasive and water stream into a water jet machine to form a water jet comprising the abrasive; and cutting a material with the water jet.

7. A method of extinguishing a fire comprising:

providing a pump according to claim 1;

establishing fluid communication of the auger housing entrance end of the pump with an additive within a reservoir surrounding the augur housing, the additive chosen from a fire retardant and a surfactant;

connecting the pump to a water stream at the liquid inlet end of the passage of the pump body;

allowing the water stream to strike the turbine of the pump in a manner as to impart rotation thereon, allowing the rotation of the turbine to impart rotation on the helical lifting auger;

allowing the rotation of the helical lifting auger to transfer a portion of the additive from the reservoir through the auger housing, out the auger housing exit end, and into the passage of the pump body where the portion of the additive mixes with the incoming water stream flowing in the passage of the pump body to produce a combined mixture of additive and water stream; and spraying the combined mixture of additive and water stream on the fire for a period of time sufficient to extinguish the fire.

8. A method of pressure washing a surface comprising:

providing a pump of claim 1;

establishing fluid communication of the auger housing entrance end of the pump with an additive within a reservoir surrounding the auger housing;

connecting the pump to a water stream at the liquid inlet end of the passage of the pump body;

allowing the water stream to strike the turbine of the pump in a manner as to impart rotation thereon;

allowing the rotation of the turbine to impart rotation on the helical lifting auger;

allowing the rotation of the helical lifting auger to transfer a portion of the additive from the reservoir through the auger housing, out the auger housing exit end, and into the passage of the pump body where the portion of the additive mixes with the incoming water stream flowing in the passage of the pump body to produce a combined mixture of additive and water stream; and spraying the combined mixture of additive and water stream on the surface for a period of time sufficient to clean the surface.

9. A pump for controllably dispensing an additive into a liquid stream and mixing therewith, the pump comprising:

a) a pump body comprising a housing having a passage therethrough with a liquid inlet end into which a liquid stream is introduced, the liquid inlet end comprising an adapter which is adapted to fit an inside diameter of a liquid supply hose, and an outlet end from which a combination mixture of the additive and the liquid stream is discharged;

b) a flow regulator positioned inside the passage configured to adjust the rate at which the incoming liquid stream enters the passage;

c) a turbine supported by a cylindrical turbine base for rotation within the passage of the pump body between the liquid inlet end and the outlet end, the passage being so shaped that the incoming liquid stream flowing in the passage strikes the turbine in a manner as to impart rotation thereon;

d) a cylindrical threaded connector having a first end fixedly attached to an auger housing and a second end fixedly secured to the cylindrical base of the turbine, the auger housing comprising an auger housing entrance end into which an additive is introduced and an auger housing exit end from which the additive is discharged, the auger housing exit end in fluid communication with the passage of the pump body between the liquid inlet end and the outlet end, such that the additive discharged from the auger housing exit end mixes with the incoming liquid stream flowing in the passage of the pump body; and e) a helical lifting auger mounted on a supporting drive shaft attached to a gear system attached to the turbine, the auger rotatably disposed within the auger housing so as to produce a fluid flow through the auger housing, the lifting auger configured to accept the additive from the auger housing entrance end; and move the additive through the auger housing to the auger housing exit end into the passage of the pump body, where the additive is mixed with the incoming liquid stream by the rotation of the turbine to produce the combined mixture of additive and liquid stream.

10. The pump of claim 9, wherein the gear system comprises:

a follower gear meshed with or otherwise disposed in geared engagement with a driver gear, the driver gear fixedly connected to a shaft that is attached to the turbine; and the follower gear fixedly connected to the supporting drive shaft of the lifting auger.

11. The pump of claim 10, wherein the follower gear is larger than the driver gear.

12. The pump of claim 10, wherein the follower gear is smaller than the driver gear.

13. The pump of claim 1, wherein the helical lifting auger comprises a continuous helical groove on a shaft.

14. The pump of claim 1, wherein the helical lifting auger comprises a plurality of inclined screw helices.

15. The pump of claim 1, wherein the helical lifting auger comprises a coil-type spring.

16. The pump of claim 1, wherein the helical lifting auger is chosen from a coil-type spring and a single thread screw.

* * * * *